US005789355A

United States Patent [19]

Adams et al.

[11] Patent Number: 5,789,355

[45] Date of Patent: Aug. 4, 1998

[54] LOW VOLATILITY LUBRICATING COMPOSITIONS

[75] Inventors: David Robert Adams, Hinton Waldrist; Paul Brice, Abingdon, both of United Kingdom

[73] Assignee: Exxon Chemical Limited, Linden, N.J.

[21] Appl. No.: 777,739

[22] Filed: Dec. 20, 1996

Related U.S. Application Data

[63] Continuation of Ser. No. 466,854, Jun. 6, 1995, abandoned.

[51] Int. Cl.[6] ..... C10M 157/04; C10M 157/10; C10M 159/12; C10M 161/00

[52] U.S. Cl. ..... 508/241; 508/234; 508/291; 508/293; 508/295; 508/287; 508/452; 508/454

[58] Field of Search ..... 508/234, 241, 508/287, 291, 293, 295, 452, 454

[56] References Cited

U.S. PATENT DOCUMENTS

| | | | |
|---|---|---|---|
| 5,128,056 | 7/1992 | Gutierrez et al. | 252/51.005 A |
| 5,151,204 | 9/1992 | Struglinski | 252/52 R |
| 5,200,103 | 4/1993 | Song et al. | 252/51.5 R |
| 5,225,092 | 7/1993 | Emert et al. | 252/50 |
| 5,266,223 | 11/1993 | Song et al. | 252/51.5 A |
| 5,334,775 | 8/1994 | Gutierrez | 568/791 |

FOREIGN PATENT DOCUMENTS

| | | | |
|---|---|---|---|
| 0 440 506 A2 | 8/1991 | European Pat. Off. | C10M 129/92 |
| 0 440 508 A2 | 8/1991 | European Pat. Off. | C10M 133/54 |
| WO 91/11469 | 8/1991 | WIPO | C08F 8/32 |
| WO 91/11488 | 8/1991 | WIPO | C08L 23/08 |
| WO 94/13709 | 6/1994 | WIPO | C08F 8/00 |
| WO 94/19436 | 9/1994 | WIPO | C10M 143/06 |

*Primary Examiner*—Jerry D. Johnson

*Attorney, Agent, or Firm*—Ohlandt, Greeley, Ruggiero & Perle

[57] ABSTRACT

This invention relates to low volatility 5W20, 5W30, 10W40, 10W50, 15W40 or 15W50 multigrade oils for crankcase lubrication of gasoline and diesel engines, the oils comprising:

a) basestock having an average basestock neutral number of not less than 105 for a 5W multigrade, not less than 145 for a 10W multigrade and not less than 200 for a 15W multigrade, b) a detergent inhibitor package including an ashless dispersant comprising an oil soluble polymeric hydrocarbon backbone having functional groups in which the hydrocarbon backbone is derived from an ethylene alpha-olefin (EAO) copolymer or alpha-olefin homo- or copolymer having an $M_n$ of from 500 to 7000, and preferably having >30% of terminal vinylidene unsaturation, and c) a viscosity modifier.

These multigrade crankcase oils provide better volatility with reduced use or even without the need for expensive light neutral basestocks or non-conventional lubricant basestocks, while at the same time providing adequate control of sludge and varnish.

7 Claims, No Drawings

LOW VOLATILITY LUBRICATING COMPOSITIONS

This is a continuation of application Ser. No. 08/466,854, filed Jun. 6, 1995 now abandoned.

FIELD OF THE INVENTION

This invention relates to low volatility lubricating compositions, particularly multigrade oils for crankcase lubrication of gasoline and diesel engines.

BACKGROUND OF THE INVENTION

Lubricating oils used in gasoline and diesel crankcases comprise a natural and/or synthetic basestock containing one or more additives to impart desired characteristics to the lubricant. Such additives typically include ashless dispersant, metal detergent, antioxidant and antiwear components, which may be combined in a package, sometimes referred to as a detergent inhibitor (or DI) package. The additives in such a package may include functionalised polymers but these have relatively short chains, typically having a number average molecular weight $\overline{M}_n$ of not not more than 7000.

Multigrade oils usually also contain one or more viscosity modifiers (VM) which are longer chain polymers, which may be functionalised to provide other properties when they are known as multifunctional VMs (or MFVMs), but primarily act to improve the viscosity characteristics of the oil over the operating range. Thus the VM acts to increase viscosity at high temperature to provide more protection to the engine at high speeds, without unduly increasing viscosity at low temperatures which would otherwise make starting a cold engine difficult. High temperature performance is usually measured in terms of the kinematic viscosity (kV) at 100° C. (ASTM D445), while low temperature performance is measured in terms of cold cranking simulator (CCS) viscosity (ASTM D5293, which is a revision of ASTM D2602).

Viscosity grades are defined by the SAE Classification system according to these two temperature measurements. SAE J300 defines the following grades:

SAE VISCOSITY GRADES

| SAE viscosity grade | Maximum COS Viscosity $10^{-3}$ Pa.s @ (°C.) | kV 100° C. $mm^2/s$ minimum | kV 100° C. $mm^2/s$ maximum |
|---|---|---|---|
| 5W | 3500 (−25) | 3.8 | — |
| 10W | 3500 (−20) | 4.1 | — |
| 15W | 3500 (−15) | 5.6 | — |
| 20W | 4500 (−10) | 5.6 | — |
| 25W | 6000 (−5) | 9.3 | — |
| 20 | — | 5.6 | <9.3 |
| 30 | — | 9.3 | <12.5 |
| 40 | — | 12.5 | <16.3 |
| 50 | — | 16.3 | <21.9 |

Multigrade oils meet the requirements of both low temperature and high temperature perfomance, and are thus identified by reference to both relevant grades. For example, a 5W30 multigrade oil has viscosity characteristics that satisfy both the 5W and the 30 viscosity grade requirements—i.e. a maximum CCS viscosity of $3500.10^{-3}$ Pa.s at −25° C., a minimum kV 100° C. of 9.3 $mm^2/s$ and a maximum kV 100° C. of <12.5 $mm^2/s$.

For multigrade oils to meet these high temperature viscosity requirements, it is necessary to add significant amounts of VM which in turn results in increased low temperature viscosity. In order to meet the requirements for wide multigrades such as 5W20, 5W30, 10W40, 10W50, 15W40 and 15W50, it is usual to reduce the basestock viscosity by blending in less viscous oils—i.e. to lower the average neutral number of the total basestock. If conventional mineral basestocks are used it is usual to replace higher viscosity basestocks such as 600N basestock in part by basestock of 150N or less to improve CCS performance in wide multigrades. This results in the formulated oil becoming more volatile which in turn increases oil consumption.

An alternative means of reducing the basestock viscosity and therefore improving CCS performance is to employ so-called non-conventional lubricants (or NCL). Examples of NCLs are synthetic basestocks such as polyalphaolefin oligomers (PAO) and diesters and specially processed mineral basestocks such as basestocks hydrocracked or hydroisomerised to give greater paraffinic content and lower aromatic content. These NCLs result in a smaller increase in volatility but are very expensive and do not respond well to conventional antioxidant systems.

The American Petroleum Institute (API) in their Publication 1509 dated January 1993 entitled "Engine Oil Licensing and Certification System" (EOLCS) in Appendix E, 1.2 provided a classification of basestocks in a number of categories, which are widely used in the lubricant inductry. Conventional mineral basestocks are in Groups 1 and 2; NCLs are basestocks that do not fall within those two Groups.

A new class of ashless dispersants comprising functionalized and/or derivatized olefin polymers based on polymers synthesized using metallocene catalyst systems are described in U.S. Pat. Nos. 5,128,056, 5,151,204, 5,200,103, 5,225,092, 5,266,223, 5,334,775; WO-A-94/19436, 94/13709; and EP-A-440506, 513157, 513211. These dispersants are described as having superior viscometric properties as expressed in a ratio of CCS viscosity to kV 100° C.

SUMMARY OF THE INVENTION

It has now been found that certain multigrade crankcase oils may be formulated with this new class of dispersant to provide better volatility with reduced use or even without the use of expensive light neutral basestocks or non-conventional lubricant basestocks. In particular the invention enables multigrade oils to be prepared with volatility performance meeting the requirements for Noack volatility, as proposed in VW 500.00, the proposed ACEA specifications and the proposed ILSAC GF-2 specification, while at the same time providing adequate control of sludge and varnish. Noack viscosity is measured by determining the evaporative loss in mass% of an oil after 1 hour at 250° C. according to the procedure of CEC-L-40-T-87.

Accordingly, in one aspect the invention provides a low volatility multigrade crankcase lubricating oil meeting SAE J300 viscosity grade 5W20, 5W30, 10W40, 10W50, 15W40 or 15W50 comprising:

a) basestock having an average basestock neutral number of not less than 105 for a 5W multigrade, not less than 145 for a 10W multigrade and not less than 200 for a 15W multigrade, b) a detergent inhibitor package of lubricating oil additives including an ashless dispersant comprising an oil soluble polymeric hydrocarbon backbone having functional groups in which the hydrocarbon backbone is derived from an ethylene alpha-olefin (EAO) copolymer or alpha-olefin homo- or copolymer having an Mn of from 500 to 7000, and c) a viscosity modifier comprising one or more polymeric additive having an Mn of greater than 20,000.

The oil may reduce or avoid the use of lighter mineral basestocks, and/or reduce or avoid the use of non-conventional lubricants, but in a preferred aspect the oil is substantially free of non-conventional lubricants as basestock.

Preferably the oil is a multigrade meeting the 5W30, 10W40 or 15W50 viscosity grade of SAE J300.

The oil preferably has a Noack volatility of not more than 17%, and more preferably not more than 13% for 10W and 15W multigrades, when measured according to CEC-L-40-T-87. The oil preferably meets the requirements of current specifications for sludge and varnish control, for example as specified in the API SH and VW 500.00 specifications.

The oil preferably contains at least 2.0 mass % of the ashless dispersant, more preferably at least 2.25 mass %, these percentages being based on active ingredient of the ashless dispersant additive.

In another aspect the invention provides the use in a multigrade crankcase oil of an ashless dispersant comprising an oil soluble polymeric hydrocarbon backbone having functional groups in which the hydrocarbon backbone is derived from an ethylene alpha-olefin (EAO) copolymer or alpha-olefin homo- or copolymer having an $\overline{M}_n$ of from 500 to 7000, to reduce the volatility of the oil. In a further aspect the invention provides a method of reducing lubricating oil consumption in an engine, in which the engine is lubricated with a multigrade crankcase oil containing an ashless dispersant comprising an oil soluble polymeric hydrocarbon backbone having functional groups in which the hydrocarbon backbone is derived from an ethylene alpha-olefin (EAO) copolymer or alpha-olefin homo- or copolymer having >30% terminal vinylidene unsaturation and an $\overline{M}_n$ of from 500 to 7000.

DETAILED DESCRIPTION

A. Basestock

The basestock used in the lubricating oil may be selected from any of the natural mineral oils of API Groups 1 and 2 (EOLCS, Appendix E, 1.2) used in crankcase lubricating oils for spark-ignited and compression-ignited engines. The basestock is selected within the constraints of the invention, depending on the viscosity grade intended for the formulated oil. Mineral basestocks are typically available with a viscosity of from 2.5 to 12 $mm^2/s$, more usually from 2.5 to 9 $mm^2/s$ at 100° C. Mixtures of conventional basestocks may be used if desired.

B. Ashless Dispersant

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone used in an ashless dispersants in the detergent inhibitor package is selected from ethylene alpha-olefin (EAO) copolymers and alpha-olefin homo- and copolymers such as may be prepared using the new metallocene catalyst chemistry, which may have a high degree, >30%, of terminal vinylidene unsaturation. The term alpha-olefin is used herein to refer to an olefin of the formula:

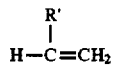

wherein R' is preferably a $C_1$–$C_{18}$ alkyl group. The requirement for terminal vinylidene unsaturation refers to the presence in the polymer of the following structure:

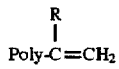

wherein Poly is the polymer chain and R is typically a $C_1$–$C_{18}$ alkyl group, typically methyl or ethyl. Preferably the polymers will have at least 50%, and most preferably at least 60%, of the polymer chains with terminal vinylidene unsaturation. As indicated in WO-A-94/19426, ethylene/1-butene copolymers typically have vinyl groups terminating no more than about 10 percent of the chains, and internal mono-unsaturation in the balance of the chains. The nature of the unsaturation may be determined by FTIR spectroscopic analysis, titration or C-13 NMR.

The oil soluble polymeric hydrocarbon backbone may be a homopolymer (e.g., polypropylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, e.g., 1 to 10 mole %, is an α,ω-diene, such as a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene). Atactic propylene oligomer typically having $\overline{M}_n$ of from 700 to 5000 may also be used, as described in EP-A-490454, as well as heteropolymers such as polyepoxides.

One preferred class of olefin polymers is polybutenes and specifically poly-n-butenes, such as may be prepared by polymerization of a $C_4$ refinery stream. Other preferred classes of olefin polymers are EAO copolymers that preferably contain 1 to 50 mole % ethylene, and more preferably 5 to 48 mole % ethylene. Such polymers may contain more than one alpha-olefin and may contain one or more $C_3$ to $C_{22}$ diolefins. Also usable are mixtures of EAO's of varying ethylene content. Different polymer types, e.g., EAO, may also be mixed or blended, as well as polymers differing in $\overline{M}_n$; components derived from these also may be mixed or blended.

The olefin polymers and copolymers preferably have an $\overline{M}_n$ of from 700 to 5000, more preferably 2000 to 5000. Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method, particularly for lower molecular weight polymers, is vapor pressure osmometry (see, e.g., ASTM D3592).

The degree of polymerisation $D_p$ of a polymer is:

$$D_p = \sum_i \frac{Mn \times \text{mol. \% monomer } i}{100 \times \text{mol. wt monomer } i}$$

and thus for the copolymers of two monomers $D_p$ may be calculated as follows:

$$D_p = \frac{Mn \times \text{mol. \% monomer 1}}{100 \times \text{mol. wt monomer 1}} + \frac{Mn \times \text{mol. \% monomer 2}}{100 \times \text{mol. wt monomer 2}}$$

In a preferred aspect of the invention the degree of polymerisation for the polymer backbones used in the invention is at least 45, typically from 50 to 165, more preferably 55 to 140.

Particularly preferred copolymers are ethylene butene copolymers.

In a preferred aspect of the invention the olefin polymers and copolymers may be prepared by various catalytic polymerization processes using metallocene catalysts which are, for example, bulky ligand transition metal compounds of the formula:

$$[L]_m M[A]_n$$

where L is a bulky ligand; A is a leaving group, M is a transition metal, and m and n are such that the total ligand valency corresponds to the transition metal valency. Preferably the catalyst is four co-ordinate such that the compound is ionizable to a $1^+$ valency state.

The ligands L and A may be bridged to each other, and if two ligands A and/or L are present, they may be bridged. The metallocene compound may be a full sandwich compound having two or more ligands L which may be cyclopentadienyl ligands or cyclopentadienyl derived ligands, or they may be half sandwich compounds having one such ligand L. The ligand may be mono- or polynuclear or any other ligand capable of η-5 bonding to the transition metal.

One or more of the ligands may π-bond to the transition metal atom, which may be a Group 4, 5 or 6 transition metal and/or a lanthanide or actinide transition metal, with zirconium, titanium and hafnium being particularly preferred.

The ligands may be substituted or unsubstituted, and mono-, di-, tri, tetra- and penta-substitution of the cyclopentadienyl ring is possible. Optionally the substituent(s) may act as one or more bridges between the ligands and/or leaving groups and/or transition metal. Such bridges typically comprise one or more of a carbon, germanium, silicon, phosphorus or nitrogen atom-containing radical, and preferably the bridge places a one atom link between the entities being bridged, although that atom may and often does carry other substituents.

The metallocene may also contain a further displaceable ligand, preferably displaced by a cocatalyst—a leaving group—that is usually selected from a wide variety of hydrocarbyl groups and halogens.

Such polymerizations, catalysts, and cocatalysts or activators are described, for example, in U.S. Pat. Nos. 4,530,914, 4,665,208, 4,808,561, 4,871,705, 4,897,455, 4,937,299, 4,952,716, 5,017,714, 5,055,438, 5,057,475, 5,064,802, 5,096,867, 5,120,867, 5,124,418, 5,153,157, 5,198,401, 5,227,440, 5,241,025; EP-A-129368, 277003, 277004, 420436, 520732; and WO-A-91/04257, 92/00333, 93/08199, 93/08221, 94/07928 and 94/13715.

The oil soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer at an olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g. polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl) cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also usable is tris(hydroxymethyl)amino methane (THAM) as described in U.S. Pat. Nos. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A 208,560; U.S. Pat. No. 4,234,435 and U.S. Pat. No. 5,229,022.

The functionalized oil soluble polymeric hydrocarbon backbones also may be derivatized with hydroxy compounds such as monohydric and polyhydric alcohols or with aromatic compounds such as phenols and naphthols. Polyhydric alcohols are preferred, e.g., alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, dipentaerythritol, and mixtures thereof. An ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding ashless dispersants comprise the ether-alcohols and including, for example, the oxy-alkylene, oxy-arylene. They are exemplified by ether-alcohols having up to 150 oxy-alkylene radicals in which the alkylene radical contains from 1 to 8 carbon atoms. The ester dispersants may be di-esters of succinic acids or acidic esters, i.e., partially esterified succinic acids; as well as partially esterified polyhydric alcohols or phenols, i.e., esters having free alcohols or phenolic hydroxyl radicals. An ester dispersant may be prepared by one of several known methods as illustrated, for example, in U.S. Pat. No. 3,381,022.

A preferred group of ashless dispersants includes those substituted with succinic anhydride groups and reacted with polyethylene amines (e.g., tetraethylene pentamine), aminoalcohols such as trismethylolaminomethane and optionally additional reactants such as alcohols and reactive metals e.g., pentaerythritol, and combinations thereof). Also useful are dispersants wherein a polyamine is attached directly to the backbone by the methods shown in U.S. Pat. Nos. 3,275,554 and 3,565,804 where a halogen group on a halogenated hydrocarbon is displaced with various alkylene polyamines.

Another class of ashless dispersants comprises Mannich base condensation products. Generally, these are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a polymer product of a metallocene cataylsed polymerisation as a substituent on the benzene group or may be reacted with a compound containing such a polymer substituted on a succinic anhydride, in a mannersimilar to that shown in U.S. Pat. No. 3,442,808.

Examples of functionalized and/or derivatized olefin polymers based on polymers synthesized using metallocene catalyst systems are described in publications identified above.

The dispersant can be further post-treated by a variety of conventional post treatments such as boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids, in an amount to provide from about 0.1 atomic proportion of boron for each mole of the acylated nitrogen composition to about 20 atomic proportions of boron for each atomic proportion of nitrogen of the acylated nitrogen composition. Usefully the dispersants contain from about 0.05 to 2.0 wt. %, e.g. 0.05 to 0.7 wt. % boron based on the total weight of the borated acyl nitrogen compound. The boron, which appears be in the product as dehydrated boric acid polymers (primarily $(HBO_2)_3$), is believed to attach to the dispersant imides and diimides as amine salts e.g., the metaborate salt of the diimide. Boration is readily carried out by adding from about 0.05 to 4, e.g., 1 to 3 wt. % (based on the weight of acyl nitrogen compound) of a boron compound, preferably boric acid, usually as a slurry, to the acyl nitrogen compound and heating with stirring at from 135° to 190° C., e.g., 140°–170° C., for from 1 to 5 hours followed by nitrogen stripping. Alternatively, the boron treatment can be carried out by adding boric acid to a hot reaction mixture of the dicarboxylic acid material and amine while removing water.

C. Viscosity Modifiers

The viscosity modifier used in the invention functions to impart high and low temperature operability to a lubricating oil. The VM used may have that sole function, or may be multifunctional.

Multifunctional viscosity modifiers that also function as dispersants are also known and may be prepared as described above for ashless dispersants. The oil soluble polymeric hydrocarbon backbone will usually have a $\overline{M}_n$ of from 20,000, more typically from 20,000 up to 500,000 or greater. In general, these dispersant viscosity modifiers are functionalized polymers (e.g. inter polymers of ethylene-propylene post grafted with an active monomer such as maleic anhydride) which are then derivatized with, for example, an alcohol or amine.

Suitable compounds for use as monofunctional viscosity modifiers are generally high molecular weight hydrocarbon polymers, including polyesters. Oil soluble viscosity modifying polymers generally have weight average molecular weights of from about 10,000 to 1,000,000, preferably 20,000 to 500,000, which may be determined by gel permeation chromatography (as described above) or by light scattering.

Representative examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

The viscosity modifier can be chosen from any of the above categories of additive in such an amount to obtain the multigrade viscosity requirements of the oil of the invention. It is preferably a polyisobutylene or copolymer of ethylene and propylene or higher alpha-olefin, as such viscosity modifiers are particularly economic and effective. However to obtain oils having a particularly high shear stability a highly shear stable viscosity modifier having an SSI of 5 or less may be used and such viscosity modifiers include in particular hydrogenated polyisoprene star polymers and hydrogenated styrene-isoprene block copolymers. An example of commercially available viscosity modifers of this type is the family of products sold by Shell International Chemical Co. Limited as their Shellvis™ 200 series.

The viscosity modifier used in any aspect of the invention will be used in an amount to give the required viscosity characteristics. Since they are typically used in the form of oil solutions the amount of additive employed will depend on the concentration of polymer in the oil solution comprising the additive. However by way of illustration, typical oil solutions of polymer used as VMs are used in amount of from 1 to 30% of the blended oil. The amount of VM as active ingredient of the oil is generally from 0.01 to 6 wt %, and more preferably from 0.1 to 2 wt %.

OTHER DETERGENT INHIBITOR PACKAGE ADDITIVES

Additional additives are typically incorporated into the compositions of the present invention. Examples of such additives are metal or ash-containing detergents, antioxidants, anti-wear agents, friction modifiers, rust inhibitors, anti-foaming agents, demulsifiers, and pour point depressants.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralised detergent as the outer layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt % (preferably at least 125 wt %) of that stoichiometrically required.

Metal salts of phenols and sulfurised phenols are prepared by reaction with an appropriate metal compound such as an oxide or hydroxide and neutral or overbased products may be obtained by methods well known in the art. Sulfurised phenols may be prepared by reacting a phenol with sulfur or a sufur containing compound such as hydrogen sulfide, sulfur monohalide or sulfur dihalide, to form products which are generally mixtures of compounds in which 2 or more phenols are bridged by sulfur containing bridges.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil soluble salts of dihydrocarbyl dithiophosphoric acids and may be represented by the following formula:

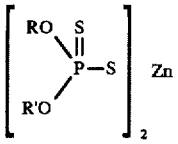

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. Conveniently at least 50 (mole) % of the alcohols used to introduce hydrocarbyl groups into the dithiophosphoric acids are secondary alcohols.

Oxidation inhibitors or antioxidants reduce the tendency of mineral oils to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines. The aromatic rings are typically substituted by one or more substituents selected from alkyl, cycloalkyl, alkoxy, aryloxy, acyl, acylamino, hydroxy, and nitro groups.

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Beizer in the "Journal of Tribology" (1992), Vol.114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferrably present in an amount not exceding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

When lubricating compositions contain one or more of the above-mentioned additives, each additive is typically blended into the base oil in an amount which enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |

-continued

| ADDITIVE | MASS % (Broad) | MASS % (Preferred) |
|---|---|---|
| Friction Modifier | 0–5 | 0–1.5 |
| Viscosity Modifier | 0.01–6 | 0–4 |
| Mineral Base Oil | Balance | Balance |

The components may be incorporated into a base oil in any convenient way. Thus, each of the components can be added directly to the oil by dispersing or dissolving it in the oil at the desired level of concentration. Such blending may occur at ambient temperature or at an elevated temperature.

Preferably all the additives except for the viscosity modifier and the pour point depressant are blended into a concentrate or additive package described herein as the detergent inhibitor package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

Preferably the concentrate is made in accordance with the method described in U.S. Pat. No. 4,938,880. That patent describes making a premix of ashless dispersant and metal detergents that is pre-blended at a temperature of at least about 100° C. Thereafter the pre-mix is cooled to at least 85° C. and the additional components are added.

The final formulations may employ from 2 to 15 mass % and preferably 5 to 10 mass %, typically about 7 to 8 mass % of the concentrate or additive package with the remainder being base oil.

The invention will now be described by of illustration only with reference to the following examples. In the examples, unless otherwise noted, all treat rates of all additives are reported as mass percent active ingredient.

EXAMPLES

Comparative Examples 1 and 2, and Examples 1 and 2

A series of multigrade crankcase lubricating oils meeting API SH/CD specifications were prepared from a mixture of a non-conventional lubricant, a hydrocracked basestock commercially available as Shell XHVI5.7 (comprising 20 mass % of the oil), and one or more mineral basestocks, a detergent inhibitor package (DI package) containing an ashless dispersant, ZDDP, antioxidant, metal-containing detergents, friction modifier, demulsifier, and an antifoam agent, and a separate viscosity modifier and pour point depressant.

The Comparative Examples used a conventional borated polyisobutenyl succinimide dispersant (PIBSA/PAM), whereas Examples of the invention used an ashless dispersants having an ethylene/butene copolymer backbone ($\overline{M}_n$ by GPC=2400, ethylene content=39 mole %, terminal vinylidene=64%) functionalised by the introduction of a carbonyl group by the Koch reaction which is in turn reacted with a polyamine and borated (EBCO/PAM). The preparation of such an ashless dispersant is described in WO-A-94/13709. The EBCO/PAM ashless dispersants was used at a lower treat rate (2.4 mass %) to that used for PIBSA/PAM, since the better dispersant performance of the former means that a smaller quantity is required to achieve adequate performance. The kV 100° C. and CCS viscosity at −20° C. for each oil was measured, and the average basestock neutral number (ave. BSNN) determined from the formula:

$$\log(ave.BSNN) = \left[ BSR1 \times \log \frac{BSNN1}{100} \right] + \left[ BSR2 \times \log \frac{BSNN2}{100} \right] + \ldots \left[ BSRn \times \log \frac{BSNNn}{100} \right]$$

where $BSRn$ = basestock ratio for basestock $n$
= (wt % basestock $n$/wt % total basestock in oil) × 100%
$BSNNn$ = basestock neutral number for basestock $n$ The results are shown in the following table, Table 1:

| Example | Comp. 1 | 1 | Comp. 2 | 2 |
|---|---|---|---|---|
| Dispersant | | | | |
| type | PIBSA/PAM | EBCO/PAM | PIBSA/PAM | EBCO/PAM |
| treat rate (mass %) | 3.0 | 2.4 | 3.0 | 2.4 |
| VM | | | | |
| type[1] | OCP | OCP | HPI | HPI |
| treat rate (mass %) | 9.8 | 9.0 | 7.5 | 7.0 |
| Basestock | | | | |
| 130N treat rate (mass %) | 12.1 | 0 | 34.4 | 0 |
| ave. BSNN | 136 | 145 | 141 | 158 |
| Viscosity | | | | |
| kV 100° C. ($mm^2/s$) | 13.64 | 14.24 | 14.06 | 14.33 |
| CCS (−20° C.) $10^{-3}$ Pa.s | 3280 | 3460 | 2960 | 3120 |
| Noack volatility (%) | 15 | 13 | 13.5 | 12 |

Footnote: [1]OCP = an oil solution of an ethylene propylene copolymer having a shear stability index of 25. HPI = a hydrogenated polyisoprene VM available from Shell International Chemical Co. Limited as Shellvis 201.

The Examples of the invention show that an oil can be prepared using less ashless dispersant, less VM, whether OCP or the more shear stable hydrogenated polyisoprene, and with no light neutral basestock (130N) while meeting the viscosity limits for 10W40 viscosity grade oils and having reduced volatility.

Comparative Examples 3 and 4, and Examples 3 and 4

A further series of oils were tested at 15W40 and 15W50 viscosity grades. The results are set out in Table 2 below:

TABLE 2

| Example | Comp. 3 | 3 | Comp. 4 | 4 |
|---|---|---|---|---|
| Dispersant | | | | |
| type | PIBSA/PAM | EBCO/PAM | PIBSA/PAM | EBCO/PAM |
| treat rate | 3.0 | 2.4 | 3.00 | 2.4 |

TABLE 2-continued

| Example | Comp. 3 | 3 | Comp. 4 | 4 |
|---|---|---|---|---|
| (mass %) | | | | |
| VM | | | | |
| type[2] | TLA | TLA | OCP | OCP |
| treat rate (mass %) | 6.7 | 6.0 | 13.0 | 10.5 |
| viscosity grade | 15W40 | 15W40 | 15W50 | 15W50 |
| Basestock | | | | |
| average neutral no. | 178 | 211 | 191 | 208 |
| Viscosity | | | | |
| kV 100° C. ($mm^2/s$) | 13.55 | 14.69 | 18.98 | 17.88 |
| CCS (−20° C.) $10^{-3}$ Pa.s | 3200 | 3290 | 3260 | 3290 |
| Noack volatility (%) | 10.5 | 9 | 9.5 | 9 |

Footnote: [2]OCP = as defined in Table 1. TLA = an oil solution of an ethylene propylene copolymer with SSI of 25, commercially available from Texaco Chemical Limited as TLA347E.

These results demonstrate that the invention enables low volatility wide multigrade oils to be prepared with higher average neutral number basestock and reduced amount of VM which may be beneficial in giving improved diesel performance such as reduced piston deposits and improved soot dispersancy in diesel lubrication and reduced turbocharger intercooler deposits.

We claim:

1. A low volatility multigrade crankcase lubricating oil meeting SAE J300 10W grade viscosity definitions and having a Noack volatility of not more than 13% when measured according to CEC-L-40-T-87, comprising:

(a) basestock containing essentially no non-conventional synthetic lubricants, said basestock having an average basestock neutral number of not less than 145, (b) a detergent inhibitor package of lubricating oil additives including an ashless dispersant comprising an oil soluble polymeric hydrocarbon backbone having functional groups in which the hydrocarbon backbone is derived from an ethylene alpha-olefin (EAO) copolymer or alpha-olefin homo- or copolymer having an $\overline{M}_n$ of from 500 to 7000, and (c) a viscosity modifier comprising one or more polymeric additive having an $\overline{M}_n$ of greater than 20,000.

2. An oil as claimed in claim 1, in which the hydrocarbon backbone of the ashless dispersant is derived from an ethylene alpha-olefin (EAO) copolymer which has >30% of terminal vinylidene unsaturation.

3. An oil as claimed in claim 1, which contains at least 2 mass % of the ashless dispersant.

4. An oil as claimed in claim 3, in which the hydrocarbon backbone of the ashless dispersant is derived from an ethylene alpha-olefin (EAO) copolymer which has >30% of terminal vinylidene unsaturation.

5. An oil as claimed in claim 4, in which the hydrocarbon backbone of the ashless dispersant is derived from an ethylene alpha-olefin (EAO) copolymer which has an $\overline{M}_n$ of from 2000 to 5000.

6. An oil as claimed in claim 5, in which the polymeric hydrocarbon backbone has a degree of polymerisation of at least 45.

7. An oil as claimed in claim 6, in which the polymeric hydrocarbon backbone has a degree of polymerisation of from 50 to 165.

* * * * *